United States Patent [19]

Itoh et al.

[11] Patent Number: 4,545,670

[45] Date of Patent: Oct. 8, 1985

[54] DEVELOPING APPARATUS USING MAGNETIC DEVELOPER

[75] Inventors: Katsuyuki Itoh; Shinichi Itoh; Michiaki Otsuki, all of Tokyo, Japan

[73] Assignee: Oki Electric Industry Co., Ltd., Tokyo, Japan

[21] Appl. No.: 540,292

[22] Filed: Oct. 11, 1983

[30] Foreign Application Priority Data

Oct. 12, 1982 [JP] Japan ..... 57-177581
Oct. 12, 1982 [JP] Japan ..... 57-177582

[51] Int. Cl.[4] ..... G03G 15/00
[52] U.S. Cl. ..... 355/3 DD; 118/657
[58] Field of Search ..... 355/3 DD, 14 D; 118/656, 657, 658; 430/122; 222/DIG. 1

[56] References Cited

U.S. PATENT DOCUMENTS 4,331,757 5/1982 Tanaka et al. ..... 355/3 DD
4,334,497 6/1982 Oka et al. ..... 118/657
4,338,880 7/1982 Tabuchi et al. ..... 355/3 DD

*Primary Examiner*—R. L. Moses
*Assistant Examiner*—David Warren
*Attorney, Agent, or Firm*—Peter L. Berger

[57] ABSTRACT

A developing apparatus for electrophotography is disclosed which comprises a toner hopper as a vessel of a magnetic developer, the toner hopper having an opening formed between one side plate of the toner hopper and a developing sleeve to effect delivery and recovery of the magnetic developer, the developing sleeve being rotated from a developing zone for developing a latent image on a latent image-bearing member with the magnetic developer toward the opening and the plate of said toner hopper other than the opening being in abutting contact with the surface of the developing sleeve, a magnet roll comprising a plurality of magnets, which is rotated in the same direction as the rotation direction of the developing sleeve on the inner side of the developing sleeve, and a stopper for regulating the zone of delivery of a layer of the magnetic developer on the surface of the developing sleeve by causing the top end of the stopper to abut on or come close to the surface of the developing sleeve along the direction of the rotation axis of the developing sleeve, wherein the rotational speed of the developing sleeve and the number of rotations of the magnet roll are set so that the thickness of the layer of the magnetic developer is adjusted to a desired value.

8 Claims, 6 Drawing Figures

DEVELOPING APPARATUS USING MAGNETIC DEVELOPER

BACKGROUND OF THE INVENTION (A) Field of the Invention

The present invention relates to a developing apparatus using a magnetic developer, in which a latent image on a latent image-bearing material being rotated is developed by a magnetic developer layer formed and delivered by utilizing the difference of the rotation speed between a developing sleeve and a magnet roll rotatably arranged on the inner side of the developing sleeve.

(B) Description of the Prior Art

In a conventional developing apparatus for developing an electrostatic latent image on a photosensitive plate with a magnetic developer, a developing sleeve and/or a magnet roll is rotated to deliver the magnetic developer in the form of a layer to the developing zone. In order to obtain a desirable thickness of the magnetic developer layer for the development, a doctor blade is arranged on an opening formed on the delivery side of a magnetic developer vessel and the distance between the doctor blade and the developing sleeve is adjusted from about 0.2 mm to about 0.5 mm according to the desirable thickness of the magnetic developer layer. However, since the flow of the magnetic developer is dammed up by the doctor blade, a large pressure is imposed on the magnetic developer, agglomeration is readily caused, the opening between the doctor blade and the developing sleeve is clogged with the agglomerates and it is sometimes impossible to form a magnetic developer layer having a uniform thickness consistently stable. This phenomenon is called "blocking".

It is known that in connection of the inhibition of occurrence of this blocking, the delivery method in which only the magnet roll is rotated or the magnet roll is mainly rotated and the developing sleeve is subsidiarily rotated is advantageous over the delivery method in which only the developing sleeve is rotated or the developing sleeve is mainly rotated and the magnet roll is subsidiarily rotated. This delivery method in which the magnet roll is mainly rotated and the developing sleeve is subsidiarily rotated is disclosed, for example, in the specification of U.S. Pat. No. 4,267,248.

According to this known delivery method, as shown in FIG. 1, a magnetic developer 10 is attached onto a cylindrical non-magnetic sleeve 14 rotatably mounted to confront a photosensitive drum 12 bearing an electrostatic latent image on the surface thereof by a magnetic attracting force of a magnet roll 16 having a plurality of magnetic poles on the surface thereof, which is rotatably arranged within the non-magnetic sleeve 14, and by the relative rotation between the non-magnetic sleeve 14 and the magnet roll 16, the magnetic developer 10 is delivered to bring the magnetic toner 10 into contact with the surface of the photosensitive drum 12. In this method, the non-magnetic sleeve 14 and the magnet roll 16 are rotated in the same direction and the rotational speed of the magnet roll 16 is made sufficiently larger than the number of rotations of the non-magnetic sleeve 14, whereby the magnetic developer 10 as a whole is delivered in a direction opposite to the rotation direction of the non-magnetic sleeve 14 and the magnet roll 16, and by adjusting the gap between the photosensitive drum 12 and the non-magnetic sleeve 14 to a value smaller than the thickness of the magnetic developer 10 on the non-magnetic sleeve 14, a developer reservoir 18 extended in a substantially uniform thickness in the circumferential direction of the non-magnetic sleeve 14 is formed in the vicinity of the point where the surface of the photosensitive drum 12 confronts the non-magnetic sleeve 14. The development is started at the point where the surface of the photosensitive drum 12 first falls in contact with the developer reservoir 18.

In this method, the gap 28 on the delivery side of the magnetic developer tank 20 is set by the doctor blade and the amount supplied of the magnetic developer 10 is regulated by this gap 28. Since the delivery of the magnetic developer 10 is mainly performed by rotation of the megnet roll 16 in this method, occurrence of blocking is effectively prevented. However, since the regulation of the gap 28 is still performed by the doctor blade, it is difficult to prevent occurrence of blocking over a long period of time. Furthermore, in this method, in the case where a large quantity of the magnetic developer 10 is stored in the magnetic developer tank 20, the magnetic developer 10 recovered from the gap 24 on the recovery side is not delivered to the gap 28 on the delivery side and is gradually accumulated in the gap 24 on the recovery side.

Furthermore, a large quantity of the magnetic developer 10 is reversely delivered from the gap 24 on the recovery side with rotation of the non-magnetic sleeve 14, and finally, the magnetic developer 10 overflows from the magnetic developer tank 20 even to the developing zone, resulting in degradation of the quality of the developed image and falling of the magnetic developer 10.

SUMMARY OF THE INVENTION

The present invention relates to a developing apparatus using a magnetic developer, which comprises a toner hopper as a magnetic developer vessel, said toner hopper having an opening formed between one side plate of the toner hopper and a developing sleeve to effect delivery and recovery of the magnetic developer, said developing sleeve being rotated from a developing zone for developing a latent image image on a latent bearing member with the magnetic developer toward said opening, a magnet roll comprising a plurality of magnets, which is rotated in the same direction as the rotation direction of the developing sleeve on the inner side of the developing sleeve, and a stopper for controlling the delivery zone for a layer of the magnetic developer on the surface of the developing sleeve by causing the top end of the stopper to abut on or come close to the surface of the developing sleeve along the direction of the rotation axis of the developing sleeve, wherein the turnover rotational speed of the developing sleeve and magnet roll are set so that the thickness of the layer of the magnetic developer is adjusted to a desirable value.

It is a primary object of the present invention to provide a developing apparatus in which by provision of a stopper which abuts on or comes close to the surface of a non-magnetic developing sleeve along the direction of the rotation axis of the developing sleeve, the delivery zone, that is, the zone for forming a layer of a magnetic developer, is controlled, and the developing sleeve and a magnet roll are rotated from a zone for developing a latent image on a latent image-bearing member toward an opening defined by one side plate of a toner hopper for the magnetic developer and the developing sleeve and the number of rotations of the developing sleeve and magnet roll are set so that the thickness of the magnetic developer is adjusted to a desirable value.

A secondary object of the present invention is to provide a developing apparatus in which by provision of a stopper which abuts on or comes close to the surface of a developing sleeve, a layer of a magnetic developer is formed between an opening and the stopper to determine the zone for the layer of the magnetic developer, and the magnetic developer is not delivered in an area other than the zone for the layer of the magnetic developer, and recovery of the magnetic developer and delivery at one point in the opening.

A third object of the present invention is to provide a developing apparatus in which at the time of termination of the development, the rotation of a magnet sleeve is first stopped and stopping of a developing sleeve is somewhat delayed so that all of a magnetic developer on the developing sleeve in the developing zone ranging from an opening to a stopper is recovered in a toner hopper, whereby absorption of moisture in the magnetic developer is substantially prevented while the development is not carried out and the development can always be performed stably without degradation of the flowability of the magnetic developer or change of the resistivity.

DETAILED DESCRIPTION OF THE PREFERRED EMBODIMENTS

Figure 1:
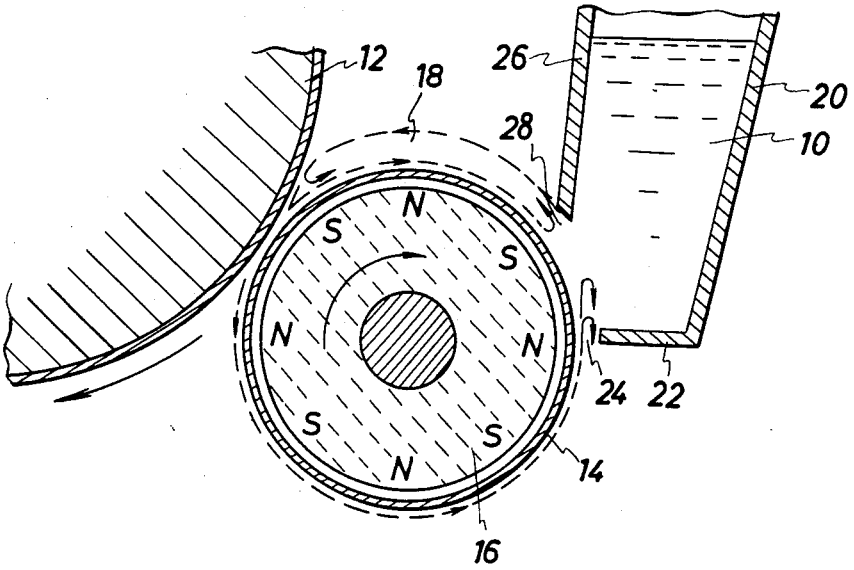
FIG. 1 Prior Art
FIG. 1 is a sectional side view showing a conventional developing apparatus using a magnetic developer.
Figure 2:
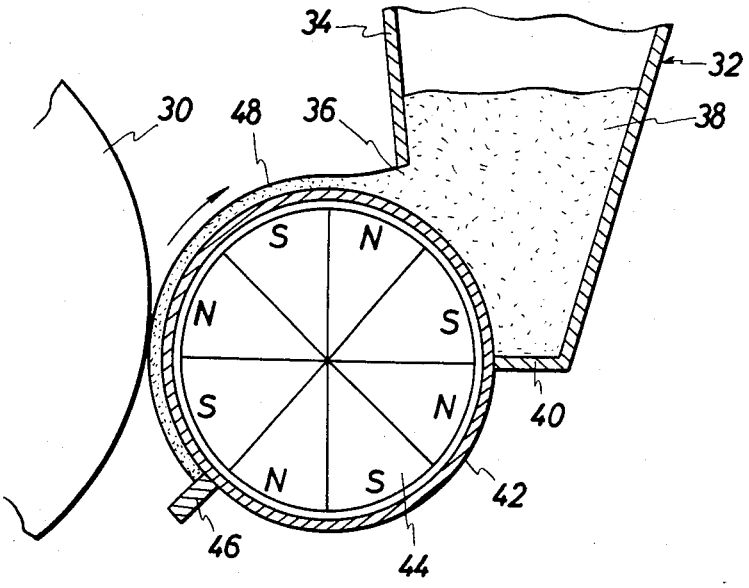
FIG. 2 is a sectional side view showing a first embodiment of the developing apparatus of the present invention.

FIG. 2 is a sectional side view showing a first embodiment of the present invention. Reference numeral 30 represents a photosensitive drum which bears an electrostatic latent image thereon and is rotated, reference numeral 32 represents a toner hopper, and reference numeral 34 represents one side plate of the hopper 32 and an opening 36 is formed in the axial direction between this side plate 34 and a developing sleeve described hereinafter.

As described hereinafter, the opening 36 need not exert a doctor blade action of controlling the thickness of a layer of a magnetic developer, but the opening acts as an inlet or outlet for discharging the magnetic developer from the toner hopper 32 or recovering the magnetic developer into the toner hopper 32. Accordingly, the clearance of the opening 36 is adjusted to about 0.2 mm to about 2.0 mm.

Reference numeral 38 represents a magnetic developer composed mainly of a magnetic material and a plastic material. Furthermore, a mixture of a non-magnetic toner and an iron powder carrier, a mixture of a magnetic toner and a carrier or a mixture of a non-magnetic toner and a magnetic toner may be used as the magnetic developer 38.

A hopper bottom plate 40 consists of a rubber plate, a synthetic resin plate or a metal plate covered with a sponge rubber, and the top end of the bottom plate 40 abuts on the developing sleeve to prevent the magnetic developer 38 from leaking out of the toner hopper 32 with rotation of the developing sleeve. Reference numeral 42 represents the above-mentioned developing sleeve composed of a non-magnetic metal, which is rotated from the developing zone of the photosensitive drum 30 toward the opening 36. Reference numeral 44 represents a magnet roll arranged within the developing sleeve 42, which comprises S and N poles arranged alternately and rotates in the same direction as the rotation direction of the developing sleeve 42.

A stopper 46 is arranged to abut on or come close to the surface of the developing sleeve 42 along the direction of the rotation axis of the developing sleeve 42, and the stopper 46 regulates the delivery zone for the magnetic developer 38. Incidentally, when the stopper 46 is caused to abut on the surface of the developing sleeve 42, the stopper 46 is constructed by a rubber or synthetic resin or metal plate covered with a sponge rubber, or when the stopper 46 is arranged closely to the surface of the developing sleeve 42 with a small clearance interposed therebetween, the stopper 46 may be composed of a metal.

The rotation direction of the developing sleeve 42 and magnet roll 44 and the delivery direction of the magnetic developer 38 will now be described.

As shown in FIG. 2, the developing sleeve 42 is rotated in a direction of an arrow. Namely, the developing sleeve 42 exerts the function of returning the magnetic developer 38 to the interior of the toner hopper 32. The magnet roll 44 is rotated in the direction of the arrow, that is, the same direction as the rotation direction of the developing sleeve 42. The direction of the magnetic force line is gradually changed with rotation of the magnet roll 44, and the magnetic developer 38 is delivered in the direction opposite to the rotation direction of the magnet roll 44. Namely, the direction of delivery by the magnet roll 44 is the direction for delivering the magnetic developer 38 out of the toner hopper 32, that is, the direction opposite to the direction of delivery by the developing sleeve 42.

Figure 3:
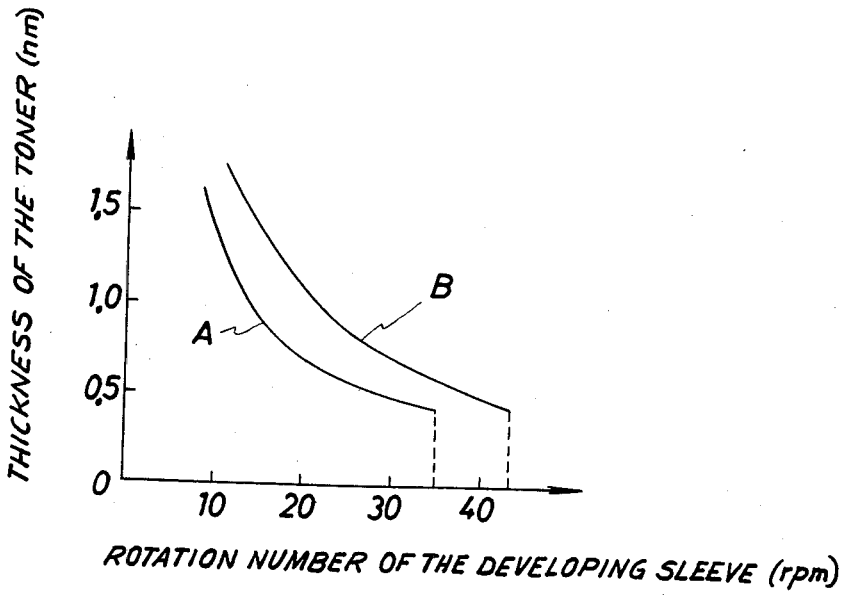
FIG. 3 is a graph illustrating the relation between the toner thickness and rotational speed in the present invention.

FIG. 3 is a diagram illustrating the relation of the thickness of the magnetic developer layer 48 to the rotational speed of the developing sleeve and magnet roll.

The developing sleeve 42 used for the experiments has a diameter of 37 mm and a length of 300 mm, and the magnet roll 44 has such a pole structure that the maximum magnetic flux density of each pole on the surface of the developing sleeve is 600 gauss. The magnetic developer used is characterized by a particle size distribution of 10 to 20 $\mu$m and a saturation magnetization of 60 emu/g.

An optical micro-diplacement gauge supplied by Zenmer Co. is used for measuring the thickness of the magnetic developer layer. As described in detail hereinafter, the chain formed of the magnetic developer rises along the magnetic force line on the pole of the magnet roll 44 and a crest of the magnetic developer layer is formed on the pole of the magnet roll 44, while the chain of the magnetic developer falls between two adjacent poles of the magnet roll 44 to form a trough of the magnetic developer layer.

The results of the measurement of the thickness of the trough of the magnetic developer layer are shown in FIG. 3. Curves A and B show the thickness of the magnetic developer layer measured when the rotational speed of the magnet roll is fixed at 1000 rpm (curve A) and 1500 rpm (curve B), respectively, while the rotational speed of the developing sleeve is changed.

The following can be seen from the measurement results.

(1) When the rotational speed of the magnet roll is fixed, the thickness of the magnetic developer layer is substantially inversely proportional to the rotational speed of the developing sleeve, and if the rotational speed of the developing sleeve is further increased, all the magnetic developer 38 is finally recovered in the toner hopper 32 and the magnetic developer 38 is not present at all outside the toner hopper 32.

(2) The thickness of the magnetic developer layer is determined by the rotational speed of the magnet roll and the rotational speed of the developing sleeve, and it has been confirmed that the reproducibility of this relation is good and this relation is stably maintained for a long time.

(3) The thickness of the magnetic developer layer 48 is not changed even if the amount of the magnetic developer 38 in the toner hopper 32 is increased or decreased.

(4) When the magnetic developer 38 being delivered on the developing sleeve 42 is discharged to the outside, the thickness of the magnetic developer layer 48 is once reduced but the magnetic developer 38 is promptly supplied from the toner hopper 32 and the original thickness is restored.

(5) The thickness of the magnetic developer layer 48 is substantially uniform in the region ranging from the vicinity of the opening 36 of the toner hopper 32 to the vicinity of the stopper 46.

(6) When a commercially available magnetic developer having a saturation magnetization of 52 emu/g and a particle size distribution of 10 to 20 $\mu$m is used instead of the above-mentioned developer, results almost equal to those shown in FIG. 3 are obtained.

The delivery action in the present invention will now be described with reference to FIG. 4 in which the respective members are linearly developed for simplification of the illustration.

When the state of delivery of the magnetic devloper in the present invention is observed, it is seen that the magnet developer layer 48 is separated into a lower layer delivered mainly by rotation of the developing sleeve 42 (hereinafter referred to as "sleeve delivery") and an upper layer delivered mainly by rotation of the magnet roll 44 (hereinafter referred to as "magnet roll delivery"). The direction and speed of the sleeve delivery are the same as the rotation direction and speed of the developing sleeve 42. It is construed that the force of restriction of the sleeve delivery is the frictional force corresponding to the component, perpendicular to the surface of the developing sleeve 42, of the magnetic attracting force to the magnetic roll 44. This force of restriction acts between the surface of the developing sleeve 42 and the magnetic developer 38 and also among the particles of the magnetic developer 38. Accordingly, the capacity of the sleeve delivery is high and a sufficiently thick layer of the magnetic developer can be formed.

Figure 4:
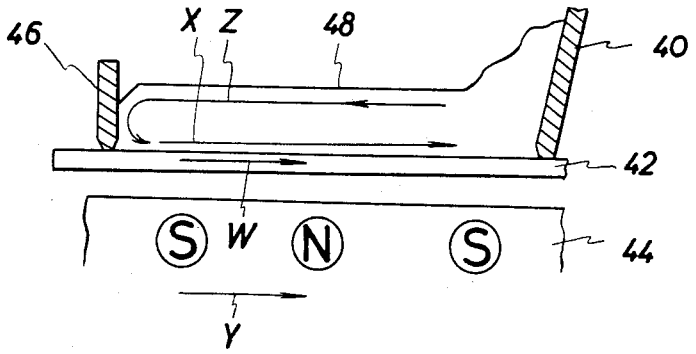
FIG. 4 is a developed diagram showing the delivery action in the present invention.

Referring to FIG. 4, the developing sleeve 42 is rotated in the direction of arrow W, and the direction of the sleeve delivery is represented by arrow X. The magnet roll delivery involves falling and rising of the chain of the magnetic developer which are due to the change of the direction of the magnetic force line, and it is understood that the speed of the magnet roll delivery is substantially equal to the product of the number of poles of the magnet roll, the turnover number of the magnet roll and the length of the chain of the magnetic developer. As described hereinbefore, the direction of the magnet roll delivery is opposite to the rotation direction of the magnet roll indicated by arrow Y in FIG. 4. In short, the direction of the magnet roll delivery is represented by arrow Z. The thickness of the magnetic developer layer restricted by the magnet roll delivery, that is, the length of the chain of the magnetic developer, is construed to depend on the magnetic characteristics of the magnetic developer and the magnetic flux density of the magnet roll. Ordinarily, the thickness of the magnetic developer restricted by the magnet roll delivery is small.

The state of delivery of the magnetic developer in the present invention will now be described more specifically with reference to FIG. 4. Since the speed of the magnet roll delivery is slightly higher than the speed of the sleeve delivery in the magnetic developer restricted by the magnet roll delivery, this magnetic developer is advanced in the direction of arrow Z on the layer of the magnetic developer restricted by the sleeve delivery at a speed corresponding to the difference between the speed of the sleeve delivery and the speed of the magnet roll delivery. When the magnetic developer impinges the stopper 46, the speed of the magnet roll delivery should naturally be reduced and made lower than the speed of the sleeve delivery. Accordingly, the magnetic developer restricted by the magnet roll delivery becomes restricted by the sleeve delivery.

Then, the toner reservoir is formed in the toner hopper 32 by the bottom plate 40 of the hopper 32, and hence, the magnetic developer advanced in the direction of arrow X is absorbed in the toner reservoir or is restricted again by the magnet roll delivery and delivered in the direction of arrow Z.

As is apparent from the foregoing description, since the magnetic developer 38 is continuously delivered, the thickness of the magnetic developer layer 48 is determined by the thickness of the layer of the magnetic developer restricted by the magnet roll delivery and the speeds of the magnet roll delivery and sleeve delivery. In other words, the magnetic developer delivered by the magnet roll delivery is recovered by the sleeve delivery. Since the restricting force of the sleeve delivery is sufficiently high, the magnetic developer 38 is formed into a toner reservoir by the bottom plate 40 of the hopper 32 stopping the sleeve delivery. This feature will now be described with reference to equations.

Assuming that the thickness of the layer of the magnetic developer restricted by the magnet roll delivery is lm and the thickness of the entire magnetic developer layer is l, the thickness of the layer of the magnetic developer restricted by the sleeve delivery is expressed as (l−lm). Assuming that the speed of the magnet roll delivery is Vm and the speed of the sleeve delivery is Vs, the following relation is established:

$$lm(Vm-Vs)=(l-lm)Vs$$

The left side of the above equation indicates the amount of the magnetic developer delivered by the magnet roll delivery and the right side indicates the amount of the magnetic developer delivered by the sleeve delivery.

The above equation can be rewritten as follows:

$$l = lm(Vm/Vs)$$

This equation indicates that when the thickness lm of the layer of the magnetic developer restricted by the magnet roll delivery is constant, the height l of the magnetic developer layer is determined by the ratio of the speed of the magnet roll delivery to the speed of the sleeve delivery. This is in agreement with the tendency observed at the experiment described hereinbefore with reference to FIG. 3. Incidentally, it must be noted that in the results obtained in the experiment, the thickness lm of the layer of the magnetic developer restricted by the magnet roll delivery is a variable of the speed Vm of the magnet roll delivery.

In the development using a magnetic developer, from the viewpoint of the quality and density of the developed image, it is important to appropriately adjust the thickness of a layer of the magnetic developer relatively to the gap between the photosensitive drum 30 and the developing sleeve 42. In the present invention, the magnetic property of the magnetic developer and the magnetic flux density of the magnet roll are factors having great influences on the developing characteristics, but since these factors cannot easily be changed, they are fixed. In the present invention, a desirable thickness of the magnetic developer layer can be determined by appropriately adjusting the rotational speed of the magnet roll and developing sleeve.

As is apparent from the foregoing description, the gap between the opening 36 of the toner hopper 32 and the developing sleeve 42 is not a factor determining the thickness of the magnetic developer layer. It has been confirmed that even if the gap of the opening 36 is smaller than the desirable thickness of the magnetic developer layer, delivery of the magnetic developer by the magnet roll delivery from the opening 36 is caused and the desirable thickness of the magnetic developer layer is obtained as in the case where the gap of the opening 36 is sufficiently broad, and that even if the development is conducted for a long time, no problem arises in connection with the supply of the magnetic developer.

It has been confirmed that even if the gap of the opening 36 is adjusted to about 0.2 mm by the side plate 34 of the toner hopper 32, the development can be carried out stably for a long time. It is construed that this is due to the fact that the force of the delivery by the magnet roll is weak and even if there is present a hindrance blocking the stream of the magnetic developer delivered by the magnet roll, agglomeration of the magnetic developer is not caused. This results in a great advantage when the developing apparatus is used in an environment where dusts are easily included in the toner hopper 32. Of course, if the gap of the opening 36 is extremely narrow, the magnet roll delivery is stopped. Namely, since the speed of the magnet roll delivery is in proportion to the length of the chain of the magnetic developer, if the length of the chain of the magnetic developer is shortened by a very narrow gap of the opening 36, the speed of the magnet roll delivery is reduced, and when the speed of the magnet roll delivery becomes lower than the speed of the sleeve delivery, the magnetic developer is not allowed to pass through the narrow gap. From the experimental results, it has been cofirmed that this narrow gap is about 0.1 mm. This fact also indicates that the stopper 46 need not be caused to abut on the surface of the developing sleeve 42. In other words, if the stopper 46 is arranged to come close to the surface of the developing sleeve 42 with a gap smaller than about 0.1 mm being interposed therebetween, the magnetic developer can be prevented from leaking out of the stopper 46.

In the conventional apparatus, at the time when the development is not conducted, the magnetic developer adheres to the surface of the developing sleeve outside the toner hopper and falls in contact with the outer air through a broad area. In this case, the magnetic developer readily absorbs moisture, resulting in degradation of the flowability of the magnetic developer or change of the resistivity thereof. If the flowability of the magnetic developer is degraded, agglomeration is readily caused in the magnetic developer and blocking is readily caused to occur in the developing apparatus. If the development is carried out in the developing apparatus where blocking occurs, white lines appear on the developed image and the image quality is drastically reduced. Since the resistivity of the magnetic developer has serious influences on the adhering force of the magnetic developer in the development process and transfer process, if the resistivity of the magnetic developer is changed, bad influences are exerted on the image quality.

In the present invention, in order to recover the magnetic developer into the toner hopper for shutting the magnetic developer from outer air and preventing absorption of moisture at the time when the development is not conducted, rotation of the magnet roll 44 is first stopped at the time of termination of the development and stopping of rotation of the developing sleeve 42 is slightly delayed. If this arrangement is adopted according to the present invention, all the magnetic developer adhering to the surface of the developing sleeve 42 in the developing zone ranging from the opening 36 to the stopper 46 can be recovered into the toner hopper 32.

Incidentally, when the development is started, one of the developing sleeve and the magnet roll is first rotated, or rotations of both of them may simultaneously be started. However, if the rising time is important, it is preferred that the magnet roll 44 be first rotated and the developing sleeve be then rotated after the lapse of a certain time. This delay time is determined according to the rotational speeds, the developing sleeve 42 and magnet roll 44 and the number of poles of the magnet roll 44. However, if the rotation speed of the developing sleeve 42 is extremely low, there is a risk of overflowing of the magnetic developer 38 stored on the stopper 46. When a certain time has passed from the start of the rotation of the developing sleeve 42 and magnet roll 44, a layer of the magnetic developer having a desirable thickness is formed on the surface of the developing sleeve 42.

Figure 5:
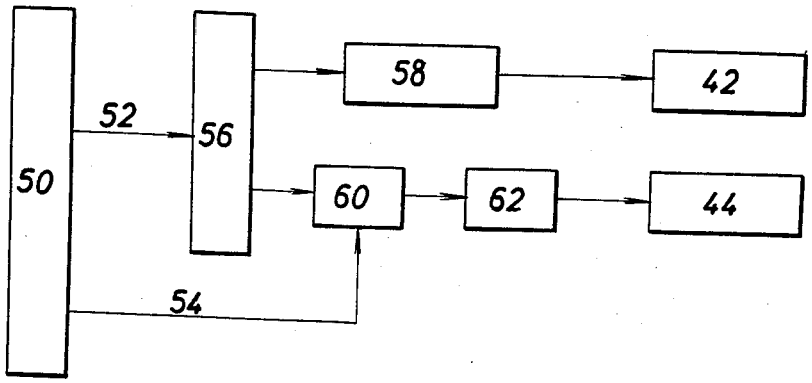
FIG. 5 is a block diagram illustrating an example of driving means in the present invention.

FIG. 5 is a block diagram illustrating an example of the structure of driving means adopted in the present invention. At the start of the development, signals 52 and 54 are simultaneously put out from a control circuit 50, and a main motor 56 acting as the driving source for the photosensitive drum 30 is rotated by the signal 52 and the developing sleeve 42 is rotated at a reduced speed through transmission means 58 such as a gear and a belt. Simultaneously, an electromagnetic clutch 60 disposed between the main motor 56 and the magnet roll 44 is actuated by the signal 54, and the rotation of the main motor 56 is transmitted to the magnet roll 44 through the electromagnetic clutch 60 and transmission means 62 and the magnet roll 44 is concurrently rotated. Just after emission of the signals 52 and 54, the magnetic developer 38 is discharged from the opening 36 and delivered to the stopper 46 and the thickness of the magnetic developer layer 48 formed on the surface of the developing sleeve 42 becomes uniform. In this state, a latent image formed on the photosensitive drum 30 is developed.

At the time of termination of the development, supply of the signal 54 from the control circuit 50 is stopped to de-energize the electromagnetic clutch 60 and stop the rotation of the magnet roll 44. After the lapse of a predetermined time from the point of stoppage of supply of the signal 54, supply of the signal 52 is stopped to stop the rotation of the main motor 56 and the rotation of the developing sleeve 42. During the period ranging from the point of stoppage of supply of the signal 54 to the point of stoppage of the signal 52, all the magnetic developer on the developing sleeve 42 is recovered in the toner hopper 32.

Figure 6:
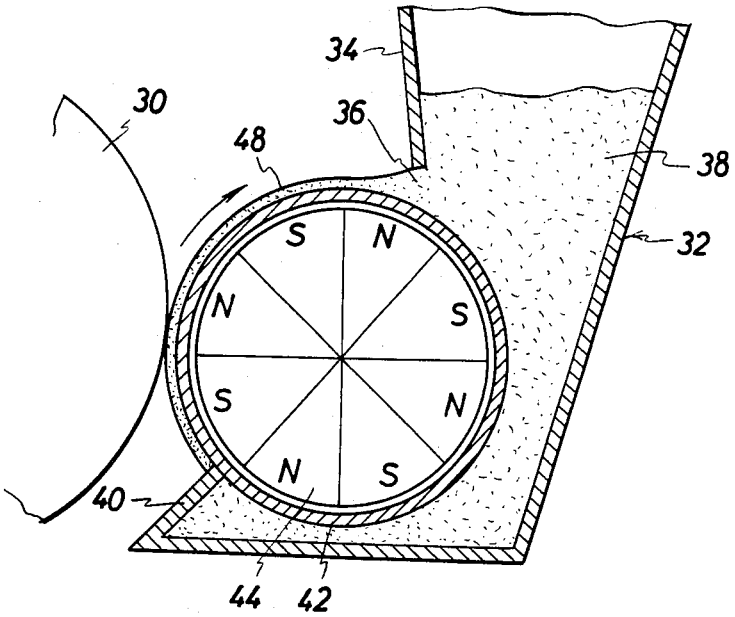
FIG. 6 is a sectional side view showing a second embodiment of the developing apparatus of the present invention.

FIG. 6 illustrates a second embodiment of the present invention. In the first embodiment described above, the stopper is constructed independently from the bottom plate of the hopper. In the second embodiment, the bottom plate of the hopper is arranged to act also as the stopper. More specifically, the toner hopper 32 comprises a bottom plate 40 surrounding the developing sleeve 42, which is arranged to act also as the stopper. The position of the bottom plate of the hopper may be the same as in the first embodiment, though not shown in FIG. 6. Even if the bottom plate of the hopper and the stopper are constructed integrally with each other as in the second embodiment, the same effect as attained in the first embodiment can similarly be attained.

As is apparent from the foregoing description, according to the present invention, the zone for delivery of the magnetic developer is regulated between the opening and the stopper, and the desirable thickness of the magnetic developer layer is set according to the balance between the sleeve delivery and the magnet roll delivery. Accordingly, the magnetic developer can be delivered without any substantial pressure being imposed thereon, and agglomeration is effectively prevented in the magnetic developer. Furthermore, since the magnetic developer layer is formed on the developing sleeve only in the delivery zone ranging from the opening to the stopper and the magnetic developer is discharged from the toner hopper and recovered into the toner hopper only through the opening, recovery of the magnetic toner is ensured.

Moreover, since rotation of the magnet roll is stopped prior to stoppage of rotation of the developing sleeve at the time of termination of the development, all the magnetic developer present on the surface of the developing sleeve can be recovered in the toner hopper, and therefor, the magnetic developer is prevented from falling in contact with air while the development is not conducted, with the result that degradation of the flowability of the magnetic developer or reduction of the resistivity is not caused at all.

What is claimed is:

1. A developing apparatus using a magnetic developer comprising a toner hopper for magnetic developer, said toner hopper having a single opening formed between one side plate of the toner hopper and a developing sleeve for delivering and recovering the magnetic developer, said toner hopper also having a bottom plate having a top end abutting the developing sleeve for preventing leakage of magnetic developer therebetween, said developing sleeve being rotatable in a direction toward said opening from a developing zone for developing a latent image on a latent image-bearing member with said magnetic developer, a magnet roll comprising a plurality of magnets inside the developing sleeve, said magnet roll being rotatable in the same direction as the developing sleeve, first motor means for adjustably controlling rotation of the developing sleeve, second motor means for adjusting and controlling rotation of the magnet roll, and a stopper means having a top end abutting or close to the surface of the developing sleeve in the direction of the axis of rotation of said developing sleeve for turning back flow of magnetic developer and preventing leakage of magnetic developer therebetween, wherein rotational speed of the developing sleeve and magnet roll are adjusted by the first and second motor means so that magnetic developer is distributed between the stopper and the hopper opening on a surface of the developing sleeve.

2. A developing apparatus as set forth in claim 1, wherein the bottom plate of the toner hopper is also the stopper.

3. A developing apparatus as set forth in claim 1, wherein the magnetic developer is a mixture of a magnetic material and a magnetic toner.

4. A developing apparatus as set forth in claim 1, wherein the magnetic developer is a mixture of a non-magnetic toner and an iron powder carrier.

5. A developing apparatus as set forth in claim 1, wherein the magnetic developer is a mixture of a magnetic toner and a carrier.

6. A developing apparatus as set forth in claim 1, wherein the magnetic developer is a mixture of a non-magnetic toner and a magnetic toner.

7. A developing apparatus as set forth in claim 1, further including means for first stopping rotation of the magnet roll and means for then stopping rotation of the developing sleeve after a predetermined time period.

8. A developing apparatus as set forth in claim 2, further including means for first stopping rotation of the magnet roll and means for then stopping rotation of the developing sleeve after a predetermined time period.

* * * * *